US012065898B2

(12) United States Patent
Shirley et al.

(10) Patent No.: US 12,065,898 B2
(45) Date of Patent: Aug. 20, 2024

(54) SYSTEM AND METHOD FOR SETTING A BARRIER IN A WELL STRING

(71) Applicant: Cameron International Corporation, Houston, TX (US)

(72) Inventors: Brandon Blake Shirley, Cypress, TX (US); Kenneth Reed, Denver, CO (US); Pheng Aun Soh, Singapore (SG); Edward Ganzinotti, III, Houston, TX (US)

(73) Assignee: Cameron International Corporation, Houston, TX (US)

( * ) Notice: Subject to any disclaimer, the term of this patent is extended or adjusted under 35 U.S.C. 154(b) by 64 days.

(21) Appl. No.: 17/756,573

(22) PCT Filed: Dec. 18, 2020

(86) PCT No.: PCT/US2020/066034

§ 371 (c)(1),
(2) Date: May 27, 2022

(87) PCT Pub. No.: WO2021/127450

PCT Pub. Date: Jun. 24, 2021

(65) Prior Publication Data

US 2022/0412183 A1 Dec. 29, 2022

Related U.S. Application Data

(60) Provisional application No. 62/951,145, filed on Dec. 20, 2019.

(51) Int. Cl.
*E21B 33/068* (2006.01)
*E21B 23/06* (2006.01)

(52) U.S. Cl.
CPC ..... *E21B 33/068* (2013.01); *E21B 23/06* (2013.01)

(58) Field of Classification Search
CPC ..... E21B 19/086; E21B 23/00; E21B 23/06; E21B 33/068
See application file for complete search history.

(56) References Cited

U.S. PATENT DOCUMENTS 4,452,304 A * 6/1984 Barrier ..... F16L 55/10 166/120
5,009,265 A * 4/1991 Bailey ..... E21B 19/086 166/123

(Continued)

FOREIGN PATENT DOCUMENTS

EP 572732 A1 * 12/1993 ..... E21B 33/03
JP 05195684 A 8/1993
KR 1020140145247 A 12/2014

OTHER PUBLICATIONS

International Search Report and Written Opinion issued in PCT Application PCT/US2020/066034, dated Apr. 8, 2021 (9 pages).

*Primary Examiner* — Jennifer H Gay
(74) *Attorney, Agent, or Firm* — Eubanks PLLC

(57) ABSTRACT

Techniques for positioning and setting a barrier within a well string are provided. In one embodiment, a method includes securing a barrier device at a lubricator extension of a lubricator assembly and positioning the lubricator assembly at a wellhead assembly having a wellhead from which a well string is suspended. The method also includes advancing the lubricator extension to advance the barrier device into the well string. The barrier device may be set within the well string to block flow. Additional methods, systems, and devices are also disclosed.

18 Claims, 7 Drawing Sheets

(56) References Cited

U.S. PATENT DOCUMENTS 5,020,590 A * 6/1991 McLeod ..... E21B 19/00 166/80.1
5,025,857 A * 6/1991 McLeod ..... E21B 23/06 166/80.1
5,088,559 A 2/1992 Taliaferro
5,332,044 A * 7/1994 Dallas ..... E21B 33/068 166/386
5,372,202 A * 12/1994 Dallas ..... E21B 33/068 166/87.1
5,568,837 A * 10/1996 Funk ..... E21B 33/068 166/383
6,009,941 A * 1/2000 Haynes ..... E21B 19/086 166/387
6,019,175 A * 2/2000 Haynes ..... E21B 33/04 166/334.1
6,938,696 B2 * 9/2005 Dallas ..... E21B 33/068 166/382
7,168,495 B2 * 1/2007 Dallas ..... E21B 33/068 166/383
7,219,737 B2 5/2007 Kelly et al.
7,584,798 B2 * 9/2009 Dallas ..... E21B 33/068 166/85.4
7,775,288 B2 * 8/2010 Hickie ..... E21B 33/068 166/75.13
9,422,784 B2 * 8/2016 Shah ..... E21B 19/00
10,605,015 B2 * 3/2020 Sipos ..... E21B 19/24
2005/0016736 A1 * 1/2005 Dallas ..... E21B 33/12 166/383
2005/0077043 A1 * 4/2005 Dallas ..... E21B 33/068 166/308.1
2008/0078558 A1 * 4/2008 Dallas ..... E21B 33/068 166/85.1
2008/0083539 A1 * 4/2008 Hickie ..... E21B 33/068 166/88.1
2022/0290524 A1 * 9/2022 El-Sayed ..... E21B 33/068
2022/0412183 A1 * 12/2022 Shirley ..... E21B 33/068

* cited by examiner

SYSTEM AND METHOD FOR SETTING A BARRIER IN A WELL STRING

CROSS-REFERENCE TO RELATED APPLICATION

The present document is based on and claims priority to U.S. Provisional Application Ser. No. 62/951,145, filed Dec. 20, 2019, which is incorporated herein by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to setting a barrier, such as a plug or valve, in a well. More specifically, some embodiments relate to positioning and setting a barrier within a well string (e.g., a casing or tubing string) via a lubricator assembly. The lubricator assembly may include a housing and a rod or other extension that can extend from the housing to advance a barrier into the well string. In some instances, the barrier is hydraulically set in the well string. The barrier may be set in the well string to block flow and allow a tree, blowout preventer, or other equipment above the barrier to be nippled down.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

The present disclosure is generally directed to setting a barrier (e.g., a plug or a valve) in a well string (e.g., a casing string or a tubing string). In some instances, casing plugs may be positioned deep within a well and set in a casing by way of wireline, coiled tubing, and other conventional conveyances, for example, to isolate one downhole zone from another. Wireline and other extended conveyances may be well-suited for positioning and setting such well-isolating barriers deep within a well. However, circumstances may arise where a barrier requires positioning and setting nearer to the surface, such as below a tree, blowout preventer, or other equipment installed on a wellhead. Unfortunately, wireline positioning and setting of a barrier at such a location may be a substantial challenge. Wireline techniques for reaching hundreds or thousands of feet into a well simply are not adept at positioning a barrier near a wellhead. The present disclosure describes a novel technique for positioning and setting a barrier within a well string.

Figure 1:
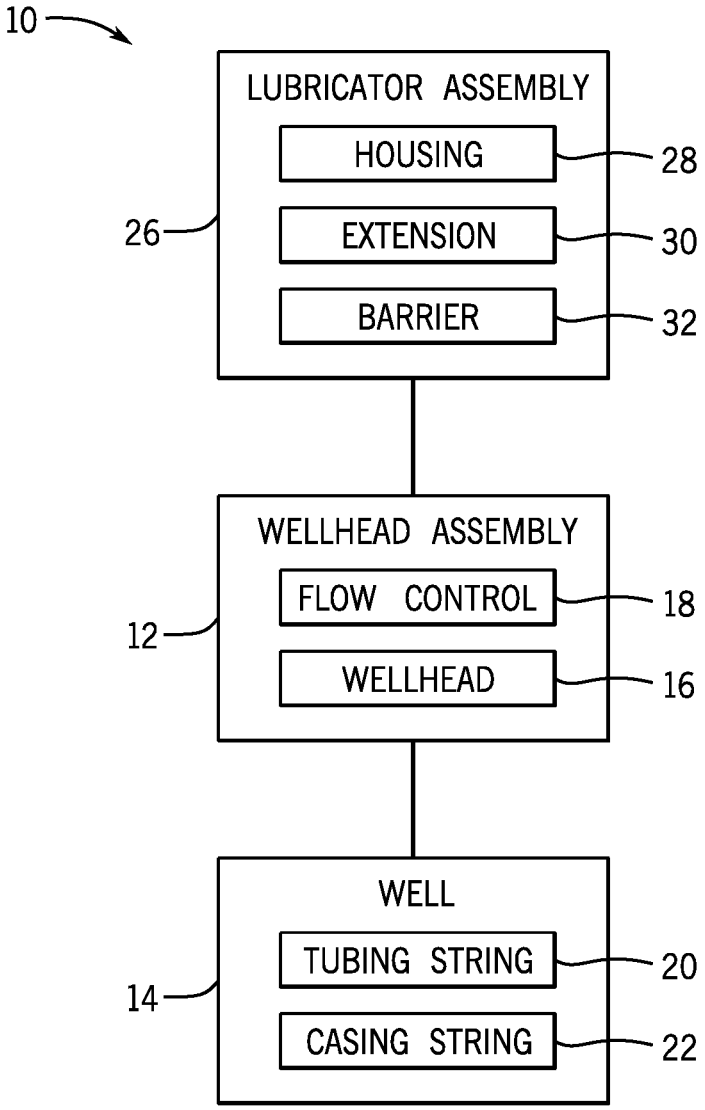
FIG. 1 generally depicts a system having a lubricator assembly with an extension that may be advanced to position a barrier in a well string in accordance with an embodiment of the present disclosure.

Turning now to the present figures, a system 10 is illustrated in FIG. 1 in accordance with one embodiment. The system 10 can be a drilling or production system having a wellhead assembly 12 that facilitates extraction of a resource, such as oil, from a reservoir through a well 14. As depicted, the wellhead assembly 12 includes a wellhead 16 and a flow control assembly 18. The components of the wellhead 16 can differ between applications and could include a variety of pressure-containing bodies (such as casing heads, tubing heads, and spools), hangers, sealing assemblies, and pressure gauges, to name only a few possibilities. For instance, the wellhead 16 can include wellhead hangers installed within a pressure-containing housing to suspend well strings, such as a tubing string 20 and one or more casing strings 22, extending into the well 14. While the tubing and casing strings 20 and 22 are generally depicted within the well 14 in FIG. 1, it will be appreciated that upper portions of these well strings can be positioned within the wellhead 16. The flow control assembly 18 can be used to control flow into or out of the well. In some embodiments, the flow control assembly 18 is a tree (e.g., a fracturing tree, a production tree, or an injection tree) or a blowout preventer.

As generally shown in FIG. 1, the system 10 may also include a lubricator assembly 26 coupled to the wellhead assembly 12 above a tree, blowout preventer, or other flow control assembly 18. The depicted lubricator assembly 26 includes a housing 28 and a lubricator extension 30. A barrier 32, such as a plug or valve, can be coupled to the lubricator extension 30, which may be extended from the housing 28 to lower the barrier 32 through the flow control assembly 18 to a desired position within a tubing string 20 (if present) or a casing string 22. The barrier 32 may then be set at that position to block flow through the well string, which may facilitate nippling down of equipment above the barrier 32, such as removal of the flow control assembly 18 from the wellhead 16. The housing 28 can include one or more pipes for receiving the lubricator extension 30 and facilitating running of the barrier 32 into and out of a well string. In at least some embodiments, the lubricator assembly 26 includes a hydraulic lubricator in which the extension 30 is extended from or retracted into the housing 28 by hydraulic pressure.

Figure 2:
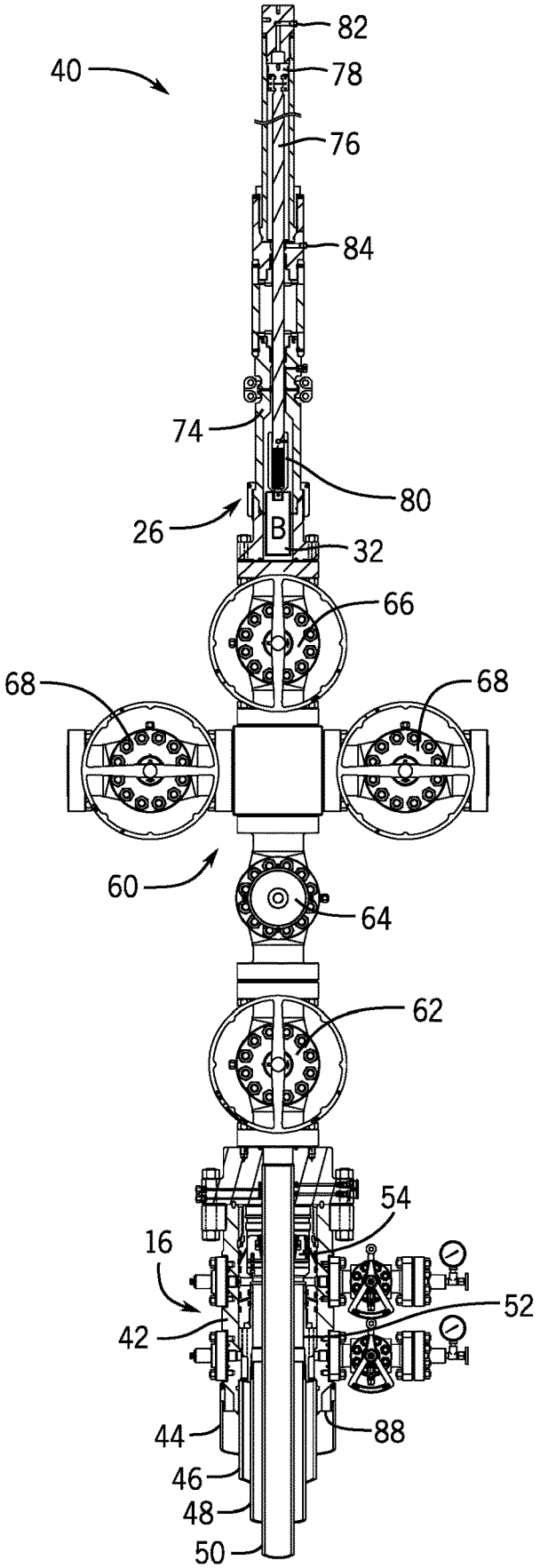
FIG. 2 is a section view of an apparatus having a wellhead, a tree mounted on the wellhead, and a lubricator assembly mounted over the tree, in which the lubricator includes a rod that may be hydraulically driven to move a barrier though the tree and into a casing string, in accordance with one embodiment.
Figure 3:
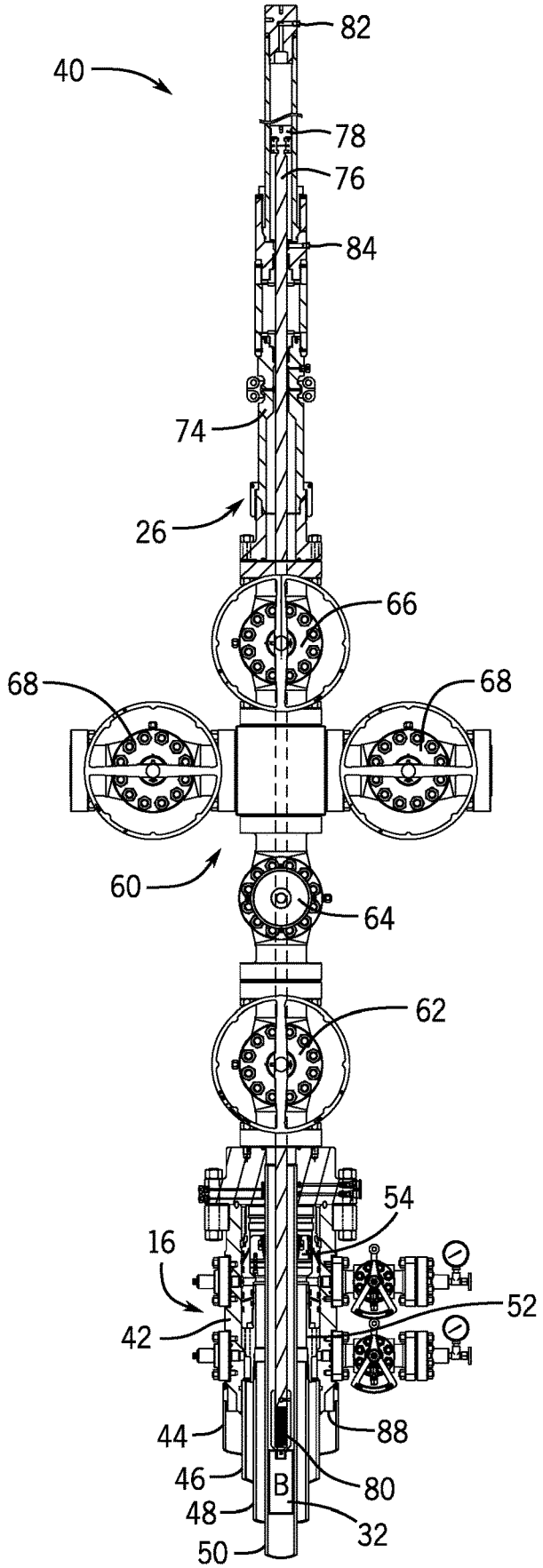
FIG. 3 is a section view like that of FIG. 2 but showing the rod stroked downward and the barrier positioned within a casing string in accordance with one embodiment.

As one example of a system 10, an apparatus 40 is shown in FIGS. 2 and 3 as having a flow control assembly 18, here in the form of a tree 60, coupled to a wellhead 16 in accordance with one embodiment. As depicted, the wellhead 16 includes a hollow body 42 from which various well strings extend into a well. The well strings can include a conductor string 44 and casing strings 46, 48, and 50 of progressively smaller diameters (e.g., surface casing, intermediate casing, and production casing). As presently depicted, the conductor string 44 and casing string 46 are secured to the body 42, while casing strings 48 and 50 are suspended from hangers 52 and 54, respectively, within the body 42. Hangers 52 and 54 may be provided in any suitable form, but in FIGS. 2 and 3 the hanger 52 is shown as a mandrel-style hanger and the hanger 54 is shown as a slip-style hanger. While FIGS. 2 and 3 show upper portions of the conductor string 44 and casing strings 46, 48, and 50, it will be appreciated that these strings can extend from the wellhead 16 deep into the well 14.

The tree 60 is installed above the wellhead 16. In at least some embodiments, including that shown in FIGS. 2 and 3, the tree 60 is a fracturing tree for use during fracturing operations at the well. In other instances, the tree 60 could be another tree, such as a production tree or an injection tree. The tree 60 in FIGS. 2 and 3 includes a lower master valve 62 and an upper master valve 64 for controlling flow into or out of the wellbore (via wellhead 16). The tree 60 may also include a swab valve 66 and wing valves 68.

A lubricator assembly 26 may be used to run a barrier 32 into a well string through the tree 60. As depicted in FIGS. 2 and 3, the lubricator assembly 26 includes a hollow body 74 (an example of the housing 28 of FIG. 1) connected above the tree 60. A rod 76 (an example of the lubricator extension 30 of FIG. 1) is received within the body 74. The rod 76 may be a solid rod, as shown in FIGS. 2 and 3, or may have an internal conduit for routing hydraulic fluid or a ball to actuate the barrier 32. An upper end of the rod 76 is coupled to a piston head 78 within the body 74. The rod 76 (e.g., a polished rod) is shown connected to the piston head 78 via a clamp in FIGS. 2 and 3, but these components can be coupled in any other suitable manner. Similarly, the barrier 32 may be secured at a lower end of the rod 76 in any suitable manner. In some instances, the barrier 32 is secured at the lower end of the rod 76 by coupling the barrier 32 to a running tool 80 at the lower end of the rod 76, but the barrier 32 could be coupled directly to the lower end of the rod 76 in other cases. The rod 76 can be provided as one single rod or a rod string having multiple rod elements. For clarity, and to depict both upper and lower ends of the lubricator assembly 26, break lines have been used in FIGS. 2 and 3 to show removal of a portion of the lubricator assembly 26. It will be appreciated that the rod 76 can have a length greater than the height of the tree 60 to enable the rod 76 to extend from the lubricator body 74, through the tree 60, and into the wellhead 16 for positioning the barrier 32 within the casing string 50.

The lubricator assembly 26 is shown in FIGS. 2 and 3 as a hydraulic lubricator assembly in which the rod 76 can be extended from or retracted into the body 74 via hydraulic actuation. More specifically, a hydraulic control fluid may be pumped into the body 74 through ports 82 and 84 to control the position of the piston head 78 and the rod 76. For instance, control fluid may be pumped into the body 74 through the port 82 to apply a downward force on the piston head 78 and cause the rod 76 to stroke downward from the position shown in FIG. 2 to the position shown in FIG. 3, which moves the barrier 32 down through the tree 60 and into the casing string 50. The rod 76 could later be returned to the position shown in FIG. 2 by pumping control fluid into the body 74 through the port 84 to apply an upward force on the piston head 78 and cause the rod 76 to retract. Hydraulically driven advancement of the extension (e.g., rod 76 in FIGS. 2 and 3) for a known distance from the lubricator assembly 26 through the tree 60 (or other flow control assembly) may provide a reliable manner of positioning the barrier 32 at a location and greater control compared to wireline positioning of the barrier 32 at such a location.

Figure 4:
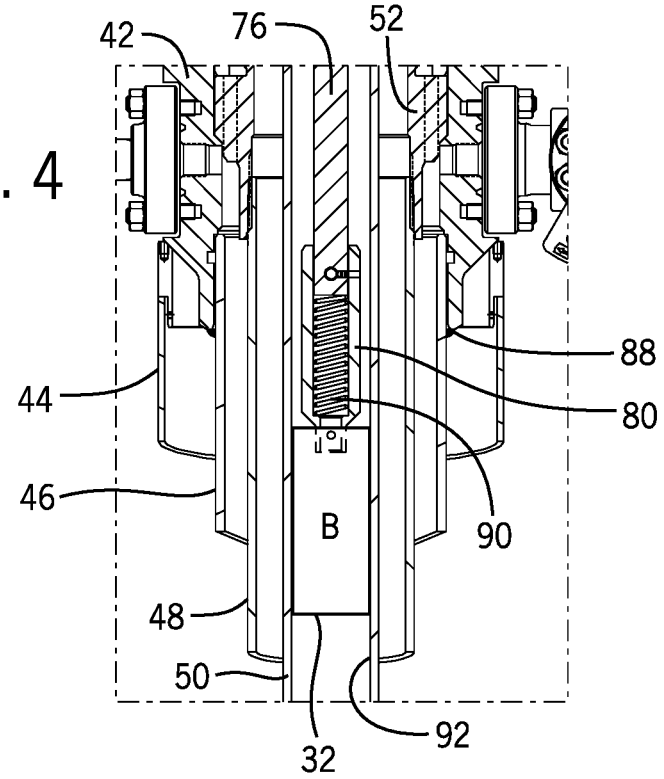
FIG. 4 is a detail view of FIG. 3 and shows the barrier positioned within the casing string in accordance with one embodiment.
Figure 5:
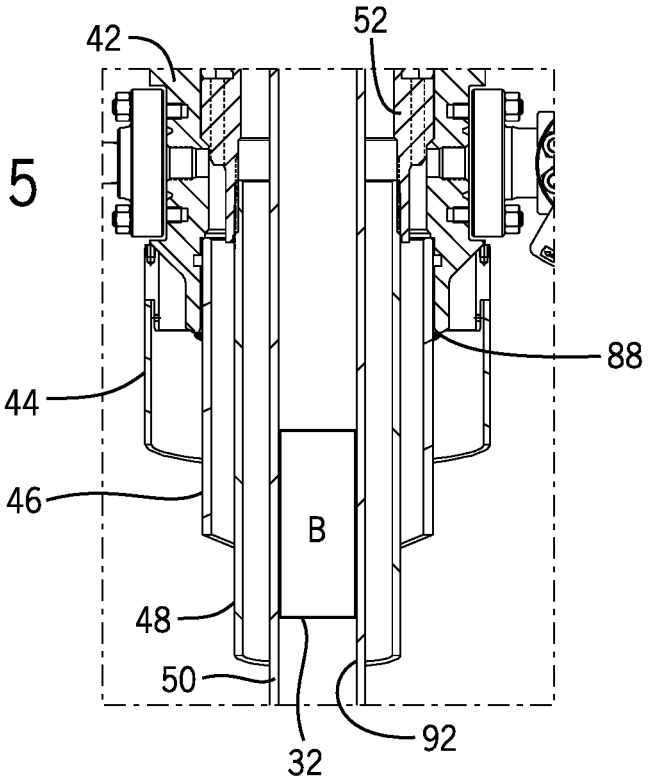
FIG. 5 shows the barrier of FIG. 4 within the casing string following disconnection and retraction of the rod from the barrier in accordance with one embodiment.

As noted above, the rod 76 may be extended from the body 74 to position the barrier 32 within the casing string 50. As shown in greater detail in FIG. 4, the rod 76 may position the barrier 32 at a location, within the casing string 50, that is below a lower end 88 of the wellhead 16. In one embodiment, the running tool 80 can include a spring 90 that may facilitate running of the barrier 32 into position (e.g., by acting as a shock absorber). Once the barrier 32 is positioned in the casing string 50 by the rod 76, the barrier 32 may be set to seal against an inner wall 92 of the casing string 50, the rod 76 may be disconnected from the barrier 32, and the rod 76 may be retracted, leaving the barrier 32 set within the bore of the casing string 50, as shown in FIG. 5. With the barrier 32 set inside the casing string 50, the tree 60 can be nippled down.

In contrast to a barrier set in a wellhead hanger above the well string, in a wellhead bore above the well string, or deep within a well inside a well string, in at least some embodiments of the present disclosure the barrier 32 (e.g., a plug or valve) is set within a well string at a location at or near the surface. As depicted in FIGS. 4 and 5, for instance, the barrier 32 is set within the casing string 50 closely below the lower end 88 of the wellhead. In other instances, the barrier 32 could be set within the casing string 50 at a higher location (e.g., a location that is inside the wellhead, is within the casing string 50, and is below, at, or above the hanger 54 from which the casing string 50 is suspended). As used herein to refer to the position of a barrier to be set in a well, the term "near-surface position" means a position that is no more than twenty feet below a surface wellhead of the well. In at least some embodiments, a barrier 32 (e.g., a plug or valve) is set within a well string (e.g., the casing string 50) at a near-surface position. In some of these instances, the barrier 32 may be set within the well string no more than five or ten feet below the wellhead 16.

Figure 6:
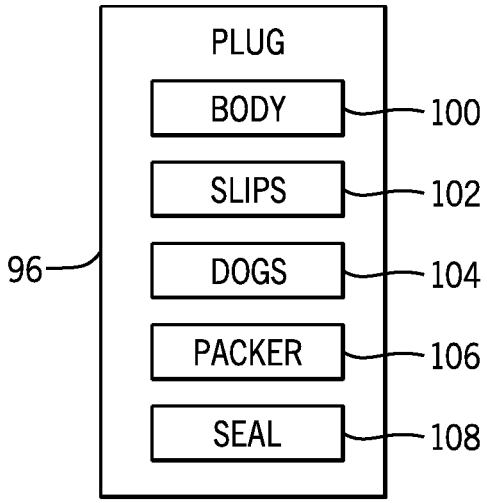
FIG. 6 generally depicts certain components of a plug that may be used as the barrier in accordance with one embodiment.
Figure 7:
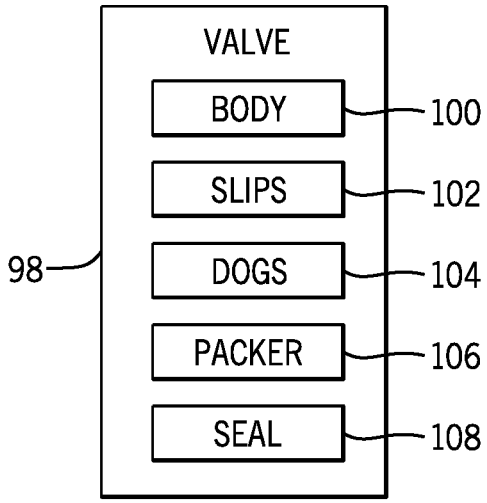
FIG. 7 generally depicts certain components of a valve that may be used as the barrier in accordance with one embodiment.
Figure 8:
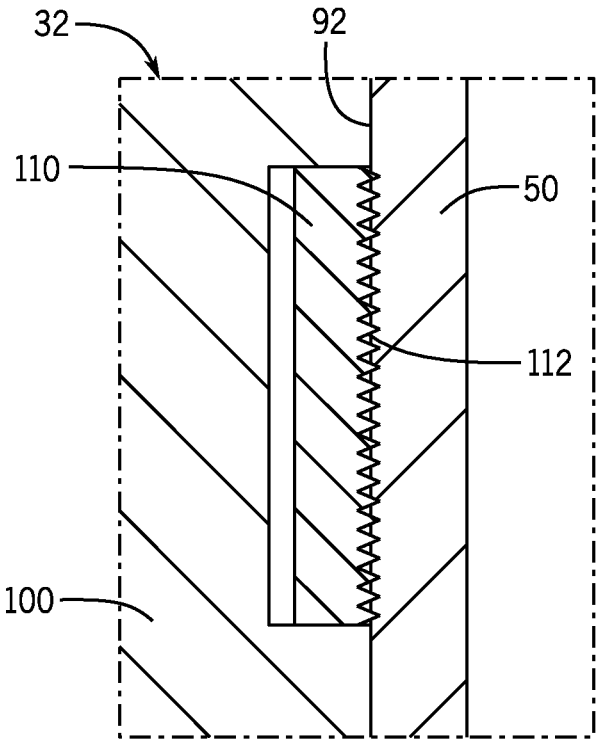
FIG. 8 generally depicts a barrier with a toothed locking device securing the barrier within a well string in accordance with one embodiment.
Figure 9:
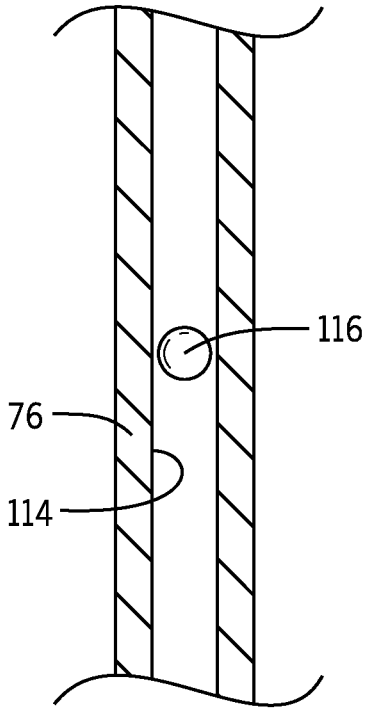
FIG. 9 generally depicts a barrier-positioning rod as having a passage for conveying hydraulic fluid or an actuation ball to the barrier in accordance with one embodiment.

In some embodiments, the barrier 32 may be provided as a plug 96 or valve 98 (e.g., a two-way check valve, a backpressure valve, or some other valve), examples of which are generally represented as block diagrams in FIGS. 6 and 7. Whether a plug 96 or a valve 98, the barrier 32 may include a body 100 that may be set within a bore of a well string to block flow. The barrier 32 may also include a mechanism that grips the inside bore wall of the well string (e.g., the inner wall 92 of the casing string 50), such as through friction or teeth that penetrate into the bore wall, to lock the barrier 32 in place. By way of example, the body 100 may be provided with one or more of slips 102, dogs 104, packer 106, or seal 108. For instance, the plug 96 or valve 98 could be set within a well string (e.g., in the casing string 50, some other casing string 22, or a tubing string 20) by engaging slips 102 or dogs 104 to secure the body 100 within the bore of the well string, and a packer 106 (e.g., a production packer, an inflatable packer, a hydraulic packer, or a swellable packer) or other seal 108 could be used to seal between the body 100 and the inner wall of the well string bore to block flow through the well string. An example of a barrier 32 with a toothed locking device 110 that secures the body 100 within the casing string 50 is depicted in FIG. 8 as having teeth 112 that engage the inner wall 92 to lock the barrier 32 in place. The locking device 110 could take any suitable form, such as a slip segment, dog, or lock ring, and may not have teeth in some instances (i.e., the locking device 110 may hold the barrier 32 in place through friction with the well string). The packer 106 or other seal 108 could be actuated to press the seal against an inner surface of the well string (e.g., against the inner wall 92). In another embodiment, a packer 106 or other seal 108 may be used to seal and to secure the plug 96 or valve 98 within the bore of the casing string 50 (e.g., via friction) without slips 102, dogs 104, or some other locking mechanism. The setting of the plug 96, valve 98, or other barrier 32 can be performed in any suitable manner. In at least one embodiment, the barrier 32 is a hydraulically set plug or valve. Hydraulic control fluid may be routed to the barrier 32 for setting, such as through one or more control lines or through a bore 114 (FIG. 9) in the rod 76. In some instances, the barrier 32 may be actuated with an object 116 (e.g., a ball or dart) passed through the bore 114 to the barrier 32 to facilitate setting. The barrier 32 may also or instead be set in other manners, such as with a cylinder, with a piston, or with an electric motor attached to the end of the lubricator to rotate a mechanism to lock the barrier 32 within the well string.

In some instances, the barrier 32 may be set at a location in a well string having a preparation (e.g., a slot, thread, or other profile) adapted to receive the barrier 32 at the location. But in at least some embodiments the barrier 32 is set at a location at which the well string does not have such a preparation. Setting the barrier 32 can include locking the barrier 32 in place within a rough casing inner diameter within expected tolerances (e.g., within the American Petroleum Institute 5C2 Tolerance band).

Figure 10:
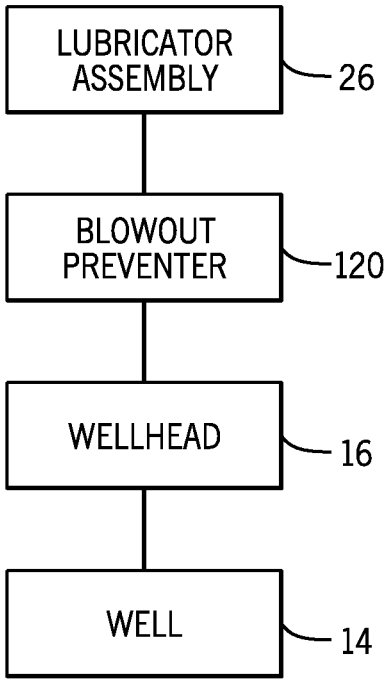
FIG. 10 generally depicts an apparatus having a blowout preventer mounted on a wellhead and a lubricator assembly that may be used to position a barrier within a casing string below the blowout preventer in accordance with one embodiment.

While certain examples of running a barrier 32 into a well string through a fracturing tree or other tree are provided above, it is again noted that the present techniques may be used to run the barrier 32 into a well string through other forms of flow control assemblies 18. As generally depicted in FIG. 10, for instance, a blowout preventer 120 can be installed on a wellhead 16 and a lubricator assembly 26 (such as the one depicted in FIGS. 2 and 3) can be used to run the barrier 32 through the blowout preventer 120 into a well string (such as a casing string 22). The barrier 32 may be set within the well string to facilitate disassembly and removal of the blowout preventer 120 from the wellhead 16. The blowout preventer 120 may include one or more ram-type preventers, one or more annular preventers, or some combination of ram-type and annular preventers. The lubricator extension 30 (e.g., rod 76) can be sized to allow the extension 30 to pass through the blowout preventer 120 and position the barrier 32 within a well string below the blowout preventer 120.

Figure 11:
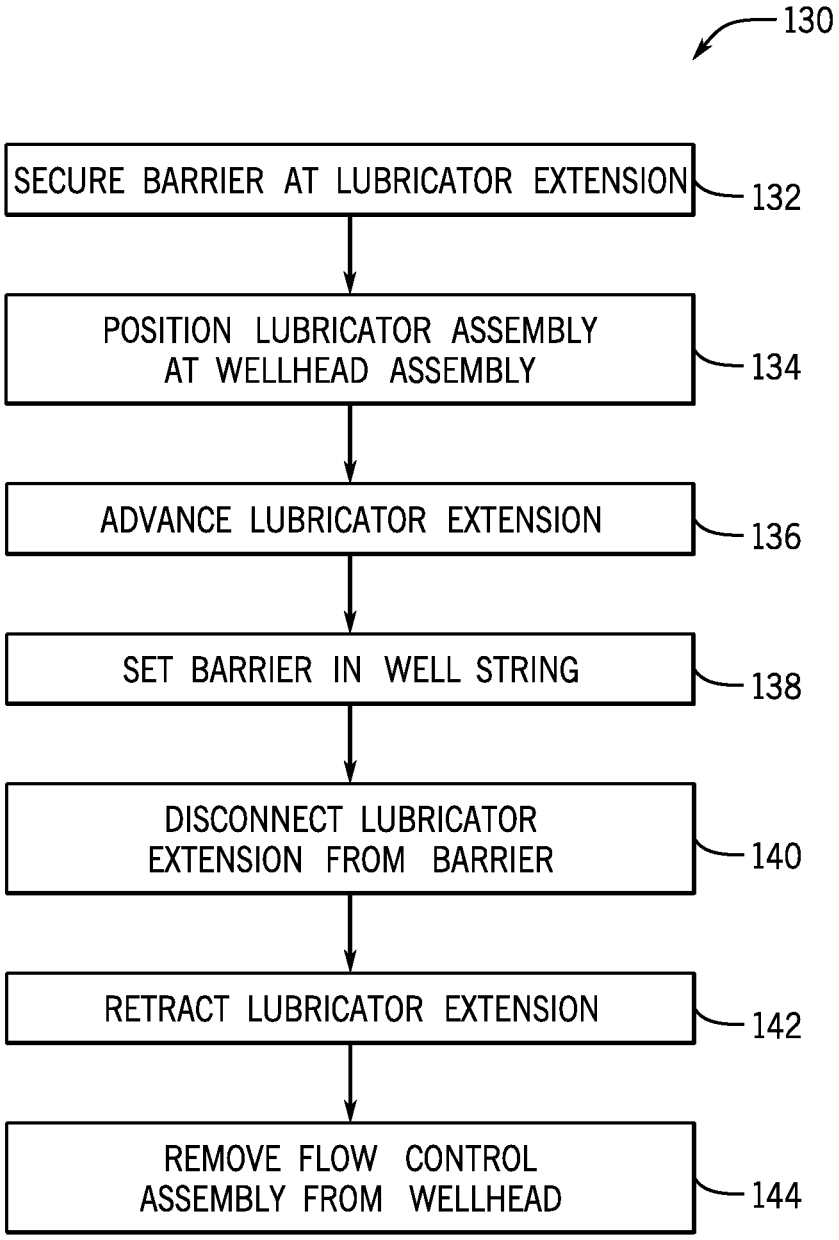
FIG. 11 is a flowchart generally representing a process of positioning a barrier in a well string in accordance with one embodiment.

Turning finally to FIG. 11, an example of a process for setting a barrier within a well string is generally represented by flowchart 130. In this embodiment, a barrier is secured at a lubricator extension of a lubricator assembly (block 132) and the lubricator assembly is positioned at a wellhead assembly (block 134). The lubricator extension may be advanced (block 136) to position the barrier within a well string (a casing or tubing string) suspended from a wellhead of the wellhead assembly. The barrier can be set within the well string (block 138) to block flow through the well string. The positioning and setting of the barrier are accomplished hydraulically in some embodiments. In others, either or both the positioning or setting may also or instead be accomplished in some other fashion, such as with an electric actuator, a pneumatic actuator, or through manual intervention. After setting, the lubricator extension can be disconnected (block 140) and retracted (block 142) from the barrier. With the barrier set in the well string, a flow control assembly, such as a tree or blowout preventer, may be removed from the wellhead (block 144).

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of positioning a barrier in a well string, the method comprising:

securing a barrier device at a lubricator extension of a lubricator assembly;

positioning the lubricator assembly at a wellhead assembly having a wellhead from which a well string is suspended, wherein the wellhead includes a hollow wellhead body and the well string is suspended from a hanger installed within the hollow wellhead body;

advancing the lubricator extension to advance the barrier device into the well string, wherein advancing the lubricator extension to advance the barrier device into the well string includes advancing the lubricator extension to advance the barrier device through the hanger to a position that is below the hanger and is within the well string; and setting the barrier device within the well string, wherein setting the barrier device within the well string includes routing at least one of a hydraulic control fluid or a ball through the lubricator extension to the barrier device to set the barrier device within the well string.

2. An apparatus comprising:

a wellhead assembly positioned at a well, the wellhead assembly including a wellhead with a hollow wellhead body and a hanger installed within the hollow wellhead body, wherein a well string is suspended from the hanger;

a lubricator coupled to the wellhead assembly, the lubricator including a hollow body and a rod received by the hollow body; and a plug or valve coupled to the rod and located below the hanger within the well string that is suspended from the hanger, wherein the plug or valve is coupled to the rod such that the plug or valve is set within the well string by routing at least one of a hydraulic control fluid or a ball through the rod to the plug or valve.

3. The apparatus of claim 2, wherein the lubricator is a hydraulic lubricator having a piston coupled to the rod.

4. The apparatus of claim 2, wherein the wellhead assembly includes a flow control assembly coupled between the wellhead and the lubricator.

5. The apparatus of claim 4, wherein the flow control assembly includes a blowout preventer or a tree.

6. A method of positioning a barrier in a well string, the method comprising:

securing a barrier device at a lubricator extension of a lubricator assembly;

positioning the lubricator assembly at a wellhead assembly having a wellhead from which a well string is suspended;

advancing the lubricator extension to advance the barrier device into the well string; and setting the barrier device within the well string, wherein setting the barrier device within the well string includes routing at least one of a hydraulic control fluid or a ball through the lubricator extension to the barrier device to set the barrier device within the well string.

7. The method of claim 6, wherein securing the barrier device at the lubricator extension of the lubricator assembly includes coupling the barrier device to a rod of the lubricator assembly.

8. The method of claim 7, wherein advancing the lubricator extension to advance the barrier device into the well string includes hydraulically driving advancement of the rod to advance the barrier device into the well string.

9. The method of claim 6, wherein the barrier device is a valve or a plug and securing the barrier device at the lubricator extension of the lubricator assembly includes coupling the valve or the plug to the lubricator extension.

10. The method of claim 6, wherein advancing the lubricator extension to advance the barrier device into the well string includes advancing the lubricator extension to advance the barrier device into a casing string.

11. The method of claim 6, wherein advancing the lubricator extension to advance the barrier device into the well string includes advancing the lubricator extension to advance the barrier device through the wellhead to a position that is below the wellhead and is within the well string.

12. The method of claim 6, wherein setting the barrier device within the well string includes engaging slips or dogs to set the barrier device within the well.

13. The method of claim 6, wherein setting the barrier device within the well string includes setting the barrier device at a location at which the well string does not have a preparation to receive the barrier device.

14. The method of claim 6, wherein setting the barrier device within the well string includes sealing between the barrier device and an inner surface of the well string.

15. The method of claim 14, wherein sealing between the barrier device and the inner surface of the well string includes actuating a seal of the barrier device to press the seal against the inner surface of the well string.

16. The method of claim 6, wherein the wellhead assembly includes a tree coupled to the wellhead and advancing the lubricator extension to advance the barrier device into the well string includes advancing the lubricator extension to advance the barrier device through the tree.

17. The method of claim 16, comprising:

disconnecting the lubricator extension from the barrier device set within the well string;

retracting the lubricator extension from the barrier device set within the well string; and removing the tree from the wellhead while the barrier device is set within the well string.

18. The method of claim 6, wherein the wellhead assembly includes a blowout preventer coupled to the wellhead and advancing the lubricator extension to advance the barrier device into the well string includes advancing the lubricator extension to advance the barrier device through the blowout preventer.

* * * * *